United States Patent [19]

Jackson

[11] Patent Number: 4,547,126

[45] Date of Patent: Oct. 15, 1985

[54] FAN IMPELLER WITH FLEXIBLE BLADES

[76] Inventor: Samuel G. Jackson, P.O. Box 16587, Lubbock, Tex. 79490

[21] Appl. No.: 559,910

[22] Filed: Dec. 8, 1983

[51] Int. Cl.[4] ..... F04D 29/24

[52] U.S. Cl. ..... 416/132 A; 416/240; 418/153

[58] Field of Search ..... 416/132 R, 132 A, 240 R; 418/154, 156, 153; 415/141

[56] References Cited

U.S. PATENT DOCUMENTS

| | | | |
|---|---|---|---|
| 1,035,364 | 8/1912 | LeBlanc | 416/240 R |
| 1,175,460 | 3/1916 | LeBlanc | 416/240 R |
| 1,325,591 | 12/1919 | Stecker | 416/240 R |
| 1,402,719 | 1/1922 | Bartlett et al. | 416/240 R X |
| 1,426,954 | 8/1922 | Brooks | 416/240 R |
| 1,868,113 | 7/1932 | Ljungstrom . | |
| 2,460,849 | 2/1949 | Senn | 170/159 |
| 2,572,334 | 10/1951 | Guibert | 418/156 X |
| 2,636,479 | 4/1953 | Smyser | 418/156 X |
| 3,045,986 | 7/1962 | Frauenberger | 416/240 R X |
| 3,080,824 | 3/1963 | Boyd | 103/117 |
| 3,202,343 | 8/1965 | Emmermann et al. | 416/132 A X |
| 3,728,043 | 4/1973 | Pratinifhi | 416/132 |
| 3,759,630 | 9/1973 | Freeman | 416/132 |
| 3,990,808 | 11/1976 | Isaacson | 416/132 A X |
| 4,334,824 | 6/1982 | Tsuchikawa | 416/132 R |

FOREIGN PATENT DOCUMENTS

| | | | |
|---|---|---|---|
| 7997 | 6/1902 | Austria | 416/240 R |
| 1185025 | 7/1959 | France | 416/240 R |
| 1305968 | 9/1962 | France | 416/240 R |

*Primary Examiner*—Everette A. Powell, Jr.

*Attorney, Agent, or Firm*—Charles D. Gunter, Jr.

[57] ABSTRACT

A fan mechanism with a fan impeller having flexible blades is shown. The fan impeller is used on a rotatable shaft which includes at least one piece of flexible belting and a plurality of elongate members carried about the shaft parallel to the longitudinal axis of the shaft for clamping the flexible belting in the approximate mid-region thereof whereby each piece of belting forms two fan blades. A retaining element located at either end of the plurality of elongate members positions the members equiangularly about the circumference of the shaft. Since one piece of belting is clamped in the mid-region to form two blades, the full strength of the belting is utilized to withstand the centrifugal forces generated during operation of the fan.

6 Claims, 8 Drawing Figures

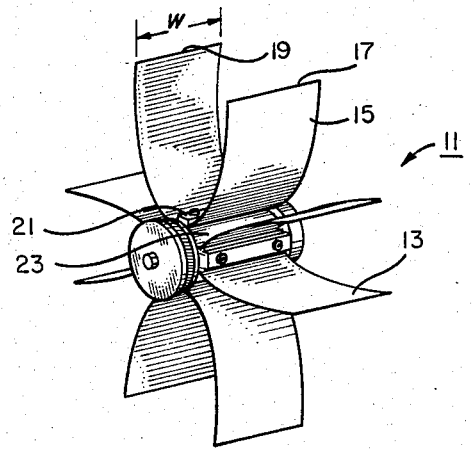
FIG. 1
FIG. 2
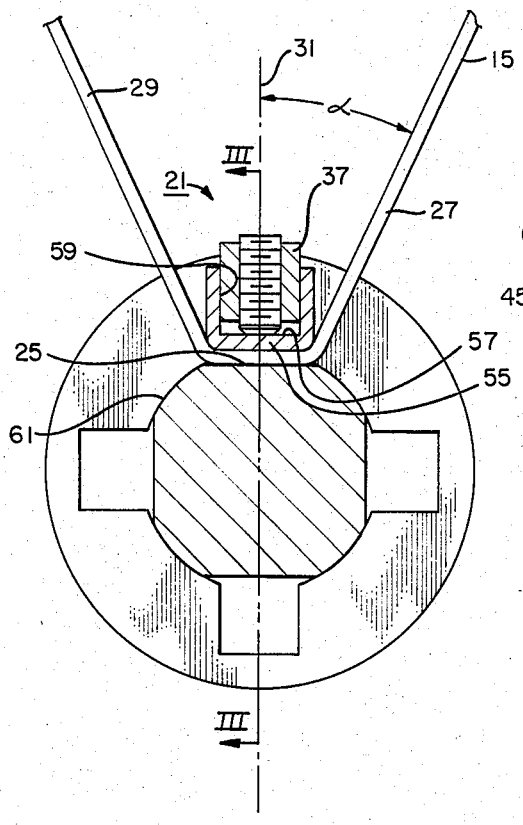
FIG. 3
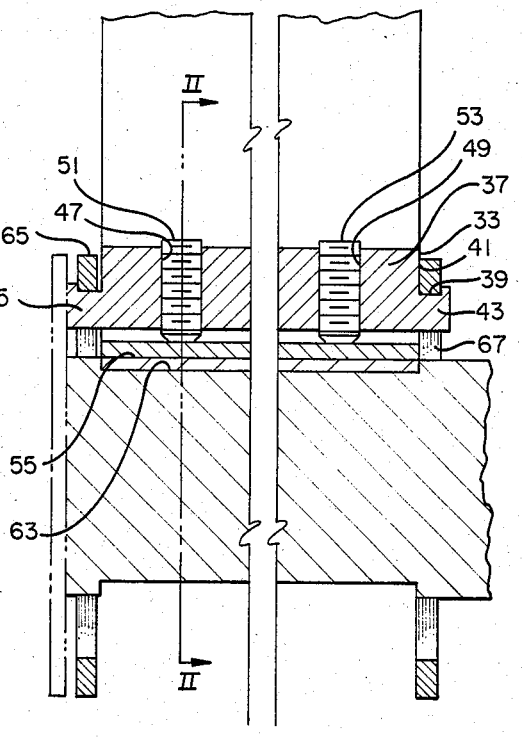

FIG. 4
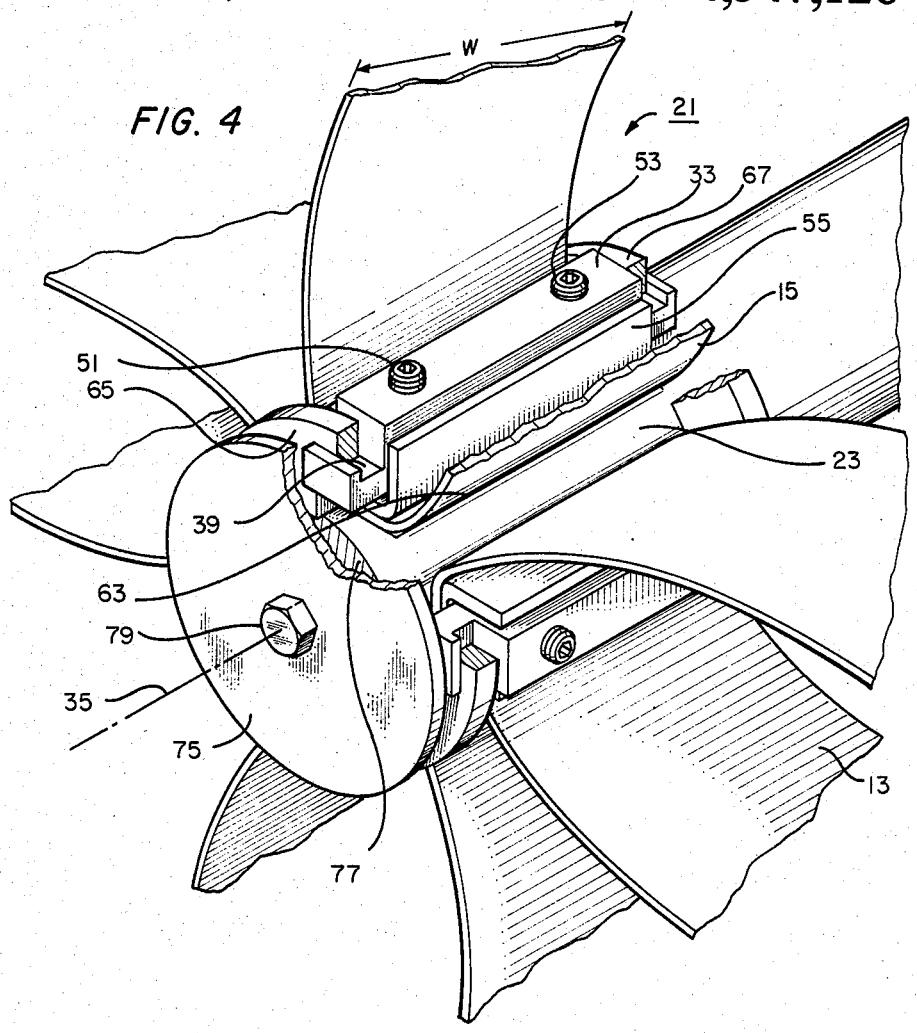
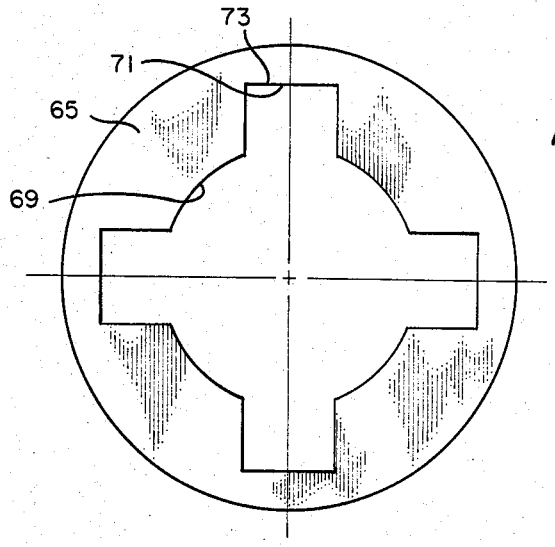
FIG. 5

FAN IMPELLER WITH FLEXIBLE BLADES

BACKGROUND OF THE INVENTION

1. Field of the Invention:

The present invention relates to fans having fan impellers with flexible blades and, specifically, to fan impellers having blades constructed of flexible belting.

2. Description of the Prior Art:

Fans, turbines, blast wheels, and the like are known which feature impellers having flexible blades on a rotating shaft for moving fluids, such as air and other gases. For instance, U.S. Pat. No. 3,080,824 to Boyd, issued Mar. 12, 1963, shows a fluid-moving device with a rotating hub to which are attached flexible vanes. U.S. Pat. No. 1,868,113 to Ljungstrom, issued July 19, 1932, shows a table fan with flexible loop-shaped blades connected at opposite ends to a rotating hub.

Fan impellers using flexible belting for blades have several advantages. Since the belting is easily cut to a desired length, an infinite number of fan diameters can be provided on a hub assembly by simply cutting the belting blades to the length desired. This allows the fan to be adapted to utilize the motor horsepower efficiently, provides for changes in air volume or pressure requirements, and allows the fan to operate on different electrical power frequencies with the consequent changes in motor speeds which result. Fans with blades of flexible belting are also easier to insert and remove from within a fan housing through a relatively small opening, since the blades can be wrapped about the shaft or hub. This greatly simplifies the design of the fan housing as compared to the use of a rigid impeller. In spite of those disadvantages, the prior designs have all be deficient in some respect. One disadvantage of the prior flexible blade fan designs was that the flexible blades were typically attached to the rotating hub at one end only. For instance, each blade was typically made of a single piece of belting, with one end looped around a pin, or the like, and clamped to the hub of the impeller. Centrifugal force generated during operation of the fans acted at the point of attachment and tended to cause the flexible blade to tear or separate. In the case of a fan impeller such as those used in cotton ginning where the fan moves dirty air with abrasive particles, the flexible blades are typically used on a 60 to 70 horsepower motor having a blade diameter of 18 to 20 inches which operates in the neighborhood of 2200 rpm. The centrifugal force generated by such fans is sufficient to cause early blade failure in prior fan designs.

SUMMARY OF THE INVENTION

The fan impeller with flexible blades of the invention is adapted to be used on a rotatable shaft. At least one piece of flexible belting is secured by clamping means to the shaft. The clamping means used to attach the flexible belting clamps each piece of flexible belting in the approximate mid-region thereof wherein each piece of belting forms two fan blades.

Each piece of flexible belting has a width, a length greater than the width, and oppositely disposed free ends. The belting is clamped midway between the free ends. Preferably the clamping means comprises a plurality of elongate members carried about the shaft parallel to the longitudinal axis thereof. The flexible belting is clamped between the elongate members and the shaft with the elongate members spanning the width of the belting and with the length of the belting arranged transversely to the axis of the shaft. A retaining ring located at either end of the plurality of elongate members positions the members equiangularly about the circumference of the shaft. A tensioning means associated with the elongate members varies the force exerted by the members in clamping the flexible belting to the shaft.

Additional objects, features and advantages will be apparent in the written description which follows.

BRIEF DESCRIPTION OF THE DRAWINGS

FIG. 1 is a perspective view of a fan impeller with flexible blades of the invention.

FIG. 2 is a partial, cross-sectional view of the fan shaft and belting taken along lines II—II in FIG. 3.

FIG. 3 is a side, partial, cross-sectional view of the fan shaft and belting taken along lines III—III in FIG. 2.

FIG. 4. is a perspective view of the fan impeller of the invention similar to FIG. 1 but with portions broken away.

FIG. 5 is an isolated view of the retaining ring used to position the clamping means of the invention.

DETAILED DESCRIPTION OF THE INVENTION

Figure 6:
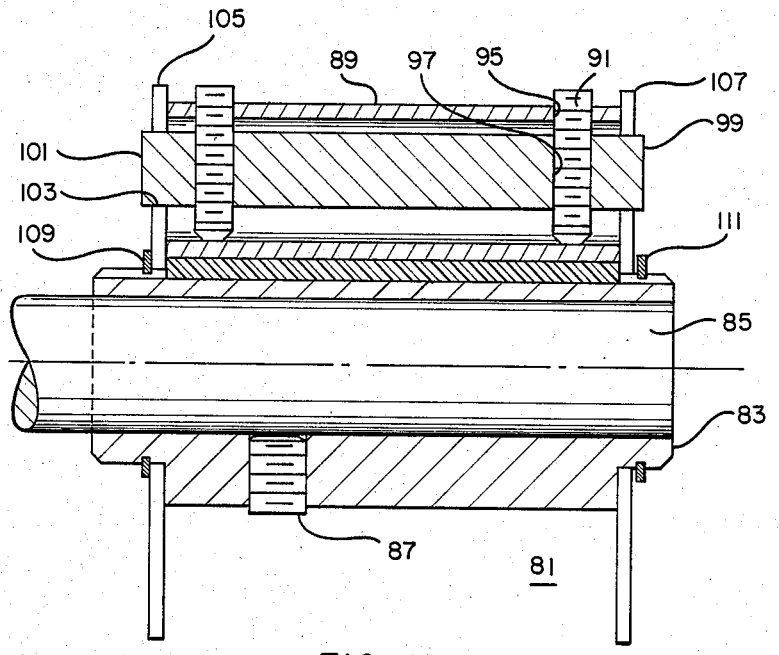
FIG. 6 is a side, cross-sectional view of another embodiment of the fan impeller of the invention, similar to FIG. 3.

FIG. 1 shows a fan impeller of the invention designated generally as 11 which is adapted to be used on a rotatable shaft such as a motor shaft or any other driven shaft, and which has a plurality of flexible blades comprised of flexible belting 13. As shown in FIG. 1, each piece of belting, such as piece 15, has a width "w", a length normally greater than the width, and oppositely disposed free ends 17, 19. A clamping means 21 associated with the fan shaft 23 clamps the flexible belting 15 in the approximate mid-region (25 in FIG. 2) so that each piece of belting 15 forms two fan blades.

As shown in FIG. 2, the flexible belting 15 can be comprised of, for instance, canvas belting, cloth, duck, or any other suitable flexible material. Preferably, the flexible belting 15 is a heavy, reinforced canvas type material with an elastomer covering. The elastomer covering of the belting resists abrasive wear where abrasive dust is present in the air or gas being handled by the fan. The belting 15 is shown in its relaxed state in FIG. 1 and assumes a curled attitude as a result of being supplied from a roll of belting. As shown in FIG. 2 for an eight blade impeller, the clamping means 21 causes the blade halves 27, 29 to form an angle alpha of around 23° with respect to the perpendicular axis 31 in operation and the blade halves 27, 29 extend more directly outward from the shaft 23 due to the effects of centrifugal force.

FIG. 4 shows the clamping means in greater detail. The clamping means 21 includes a plurality of elongate members 33 which are carried about the fan shaft 23 parallel to the longitudinal axis 35 of the shaft. The flexible belting 15 is clamped between the elongate members 33 and the shaft 23 with the elongate members 33 spanning the width "w" of the belting 15 with the length of the belting arranged transversely to the axis 35 of the shaft 23.

As shown in FIG. 3, each elongate member 33, in the embodiment shown includes a metal bar 37 of generally rectangular cross-sectional area having end recesses 39 formed between the bar end faces 41 and oppositely extending legs 43, 45. Each bar 37 is provided with threaded bores 47, 49 for receiving tensioning means such as the set screws 51, 53.

As best seen in FIG. 2, the elongate members also include channel members 55 with generally U-shaped recesses 57 into which the bars 37 are received. The openings 59 of the channel members 55 face outwardly from the exterior surface 61 of the motor shaft in the assembled condition. As shown in FIG. 4, the fan shaft 23 has a plurality of milled flats 63 parallel to the shaft axis 35 of the approximate width of the belting 15 to prevent sliding movement of the belting along the shaft 23. Although in the embodiment shown, four clamping means and pieces of flexible belting are shown, it should be understood that greater or lesser numbers can be utilized.

As shown in FIGS. 3, 4, and 5 the clamping means also includes a retaining element such as the retaining rings 65, 67 located at either end of the plurality of elongate bars 37. As shown in FIG. 5, each retaining ring 65 includes a central opening 69 for receiving the shaft 23 and a plurality of retaining recesses 71 for positioning the respective elongate bars and channel members 37, 55 equiangularly about the circumference of the shaft 23. The recess walls 73 of the retaining recesses 71 are received within the end recesses 39 of the elongate bars 37. A resilient disk 75 is fitted on the shaft end 77 to cover the shaft end 77 and extend at least partly over the clamping means to shield the clamping means 21 from abrasive dust in the fluid where this is appropriate.

The method of installing and operating the fan impeller with flexible blades of the invention will now be described. With reference to FIG. 4, the clamping means including the plurality of elongate members 33 will be positioned about the circumference of the shaft 23 parallel to the longitudinal axis 35 and with the retaining rings 65, 67 engaged within the end recesses 39 of the bars 37 and with set screws 51, 53 loosened outwardly from within their respective threaded bores. In this condition, a belt-receiving opening would be provided between the elongate members 33 and the shaft milled surfaces 63. A piece of flexible belting 15 can thus be inserted through each of the belt receiving openings created by the elongate members 33 and the shaft exterior with the belting positioned so that a mid region (25 in FIG. 2) intermediate the free ends thereof would be beneath the channel members 55 of the clamping means. The flexible belting is then clamped in the mid region by tightening set screws 51, 53 which serves to urge the elongate members in the direction of the shaft 23 to decrease the size of the belt-receiving openings whereby each piece of belting forms two fan blades. The resilient disk 75 can then be positioned upon the shaft end 77 and held in place by a bolt 79. Worn belting can be replaced by simply loosening set screws 51, 53 and pulling out the old piece of belting. A new piece of belting could then be inserted within the belt receiving opening and the screws 51, 53 would be retightened.

Figure 7:
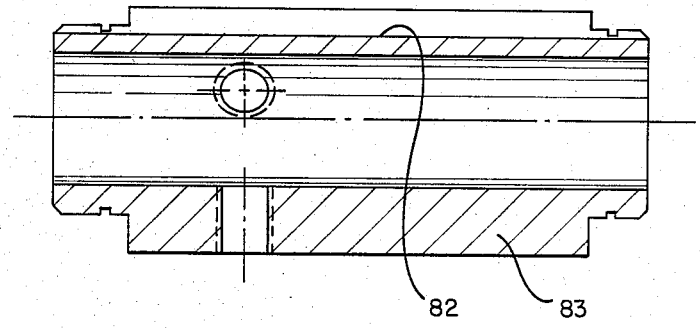
FIG. 7 is an isolated, side, cross-sectional view of the hub of the fan impeller of FIG. 6.
Figure 8:
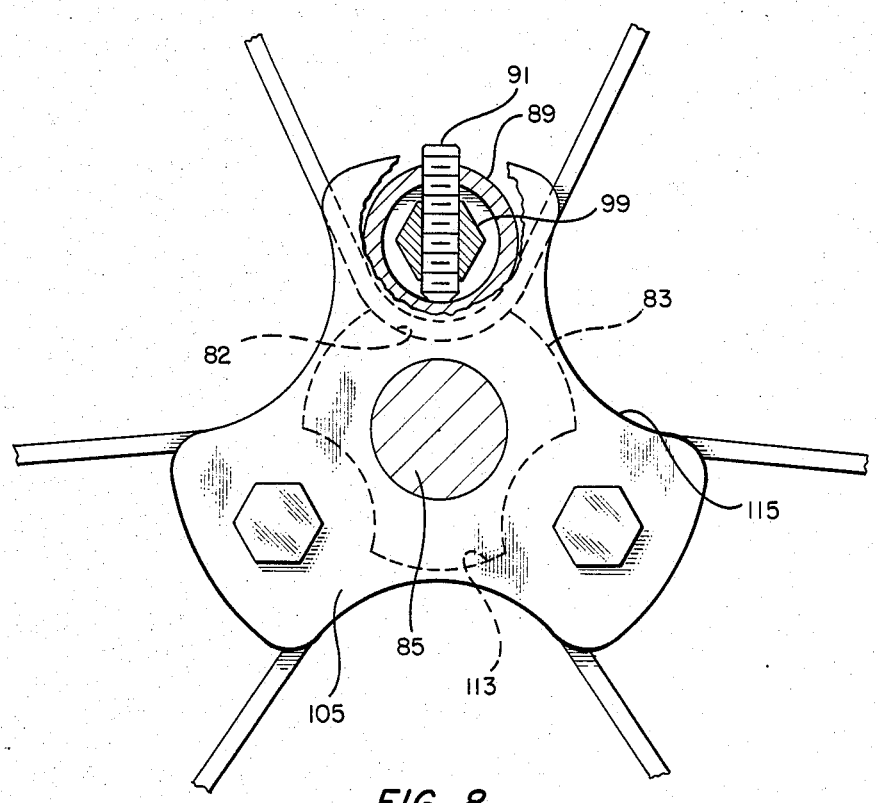
FIG. 8 is an end view of the fan impeller of FIG. 6, partly broken away.

FIGS. 6, 7, and 8 illustrate another embodiment of the clamping means of the invention. The impeller shown in these figures is a six-blade impeller using three pieces of belting 81. An impeller hub 83 has three longitudinal cylindrical depressions or grooves 82 into which the pieces of belting are clamped. The hub 83 is attached to the motor shaft 85 by set screws 87. The hub could also be keyed to the shaft.

Each piece of belting 81 is pressed into its respective groove 82 by a cylindrical steel tube 89. Two socket set screws 91 bear against the inner surface of each tube 89, forcing the tubes and belting into the grooves 82. The set screws 91, in turn, exert reactionary forces against the threaded bores 97 in hexagonal bars contained within steel tubes 89.

The ends 101 of hexagonal bars 99 pass through hexagonal holes 103 in hub plates 105, 107 carried at either ends of the tubes 89. The fit of bars 99 in the hexagonal holes 103 prevents the rotation of the hexagonal bars 99. Since the socket end 93 of each set screw 91 protrudes through a hole 95 in the wall of the tube 89, the tube cannot rotate. Snap rings 109, 111 retain the hub plates 105, 107 in position on the hub 83.

As shown in FIG. 7, each of the hub plates 105, 107 has a center opening 113 to position it upon the hub 83. Three scallops 115 allows free passage of air or gas into the impeller.

An invention has been provided with several advantages. Since the fan diameter can be varied by simply cutting the flexible blades to the desired length, the fan impeller can be mounted directly on the motor shaft without the size, weight and expense disadvantages of a speed-changing drive. In even large diameter impellers, the flexible blades can be wrapped about the impeller hub or shaft for insertion into and removal from a fan housing opening of relatively small diameter. The flexible belting can be covered with an elastomer which helps withstand the abrasive dust present in air or gas handled by such fans and the blades can be replaced quickly and economically. With the new types of flexible belting now available, which are thinner, stronger and lighter, an impeller assembly of the present design can be made to run smoothly without the expense of balancing the blades.

Since one piece of belting forms two blades, the full strength of the belting can be utilized to withstand the centrifugal force generated during the operation of the fan. This allows the use of larger diameter blades and higher rotational speeds. Since the assembled length of each fan blade is less dependent upon careful assembly method, a fan is provided with better balance and control over the impeller diameter. The clamping means shown can be inexpensively produced to provide an economical fan design. In the embodiment shown, the length of the impeller along the shaft is not much greater than the width of the belting blades. This is an important consideration in mounting the impeller directly on a motor shaft.

While the invention has been shown in only two of its forms, it is not thus limited but is susceptible to various changes and modifications without departing from the spirit thereof.

I claim:

1. A fan impeller with flexible blades, being rotatable to move a stream of fluid, comprising:

a plurality of pieces of unpierced, flexible belting, each of said pieces of belting having a width, a length normally greater than said width, and oppositely disposed free ends, and said pieces of belting each having a central portion located mid-way between said free ends;

a central rotating means having a plurality of depressions for receiving a central portion of said belting pieces;

a plurality of elongate clamping members, spaced radially from said depressions for forming belt receiving openings;

a plurality of tensioning members which act upon said elongate clamping members to urge said belting central portions into said depressions;

a plurality of elongate support members against which said tensioning members react; and a retaining plate at each end of said elongate support members to radially restrain said support members.

2. A fan impeller with flexible blades, being rotatable to move a stream of fluid, comprising:

a plurality of pieces of unpierced, flexible belting, each of said pieces of belting having a width, a length normally greater than said width, and oppositely disposed free ends, and said pieces of belting each having a central portion located mid-way between said free ends;

a central rotating means having a plurality of depressions for receiving a central portion of said belting peices, said depressions comprising a plurality of milled flats in said central rotating means, each of said flats being adapted to receive a piece of belting;

a plurality of elongate clamping members, spaced radially from said depressions for forming belt receiving openings;

a plurality of tensioning members which act upon said elongate clamping members to urge said belting central portions into said depressions;

a plurality of elongate support members against which said tensioning members react; and a retaining plate at each end of said elongate support members to radially restrain said support members.

3. The fan impeller of claim 2, wherein said support members are metal bars of generally rectangular cross-sectional area, each of said bars being provided with threaded bores for receiving said tensioning members.

4. The fan impeller of claim 2, wherein said clamping members are channel members having generally U-shaped recesses into which said metal bars are received, the openings of said recesses facing outwardly from the exterior of said central rotating means, whereby tightening said tensioning means within said threaded bores serves to urge said channel members in the direction of said belting to squeeze said belting against said central rotating means.

5. A fan impeller with flexible blades, being rotatable to move a stream of fluid, comprising:

a plurality of pieces of unpierced, flexible belting, each of said pieces of belting having a width, a length normally greater than said width, and oppositely disposed free ends, and said pieces of belting each having a central portion located mid-way between said free ends;

a central rotating means;

an impeller hub adapted to be received about said central rotating means, said impeller hub having a plurality of depressions for receiving a central portion of said belting pieces;

a plurality of elongate clamping members, spaced radially from said depressions for forming belt receiving openings;

a plurality of tensioning members which act upon said elongate clamping members to urge said belting central portions into said depressions;

a plurality of elongate support members against which said tensioning members react; and a retaining plate at each end of said elongate support members to radially restrain said support members.

6. The fan impeller of claim 5, wherein said clamping members are cylindrical tubes and said support members are metal bars passing through said cylindrical tubes, said bars having threaded bores for receiving said tensioning means, whereby tightening said tensioning means urges said tensioning means against the inner surface of each tube, thereby squeezing said belting into said cylindrical depressions.

* * * * *